US012410556B2

(12) United States Patent
Hughson et al.

(10) Patent No.: US 12,410,556 B2
(45) Date of Patent: Sep. 9, 2025

(54) SYNTHETIC ROPE FOR SYSTEM LEVEL RECOIL CONTROL

(71) Applicant: SAMSON ROPE TECHNOLOGIES, INC., Ferndale, WA (US)

(72) Inventors: John Hughson, Bellingham, WA (US); James Plaia, Blaine, WA (US); Dustin Heins, Bellingham, WA (US)

(73) Assignee: SAMSON ROPE TECHNOLOGIES, INC., Ferndale, WA (US)

( * ) Notice: Subject to any disclaimer, the term of this patent is extended or adjusted under 35 U.S.C. 154(b) by 168 days.

(21) Appl. No.: 18/496,592

(22) Filed: Oct. 27, 2023

(65) Prior Publication Data

US 2024/0141586 A1 May 2, 2024

Related U.S. Application Data

(60) Provisional application No. 63/381,814, filed on Nov. 1, 2022.

(51) Int. Cl.

| | |
|---|---|
| ***D07B 1/00*** | (2006.01) |
| ***D07B 1/16*** | (2006.01) |
| *B63B 21/20* | (2006.01) |

(52) U.S. Cl.

CPC ..... *D07B 1/24* (2021.01); *D07B 1/16* (2013.01); *B63B 21/20* (2013.01); (Continued)

(58) Field of Classification Search

CPC ..... D07B 1/025; D07B 1/04; D07B 1/145; D07B 1/16; D07B 1/18; D07B 1/24; (Continued)

(56) References Cited

U.S. PATENT DOCUMENTS 4,321,854 A * 3/1982 Foote ..... D07B 1/04 87/8
7,127,878 B1 * 10/2006 Wilke ..... D07B 1/02 57/231

(Continued)

FOREIGN PATENT DOCUMENTS

WO WO-2010009360 A2 * 1/2010 ..... D07B 1/04
WO WO-2013163094 A1 * 10/2013 ..... D07B 1/148

*Primary Examiner* — Shaun R Hurley

(74) *Attorney, Agent, or Firm* — McNees Wallace & Nurick LLC

(57) ABSTRACT

A rope system for system level recoil control and method for providing a rope system for system level recoil control are provided. The rope system includes a first rope component and a second component, and the second rope component is connected in series to the first rope component. The first rope component includes a first rope subcomponent and a second rope subcomponent, the first rope subcomponent has predetermined failure strength and is designed and configured to be a controlled failure point for the system, and the second rope subcomponent has a predetermined elongation capability. Upon failure of the first rope subcomponent, the second rope subcomponent is configured to elongate to absorb a predetermined amount of a predetermined operational strain energy of the rope system and to stretch over a predetermined distance and/or predetermined period of time before the second rope subcomponent fails.

21 Claims, 2 Drawing Sheets

(52) U.S. Cl.
CPC ..... *B63B 2021/203* (2013.01); *D07B 2201/2068* (2013.01); *D07B 2401/2005* (2013.01); *D07B 2501/2061* (2013.01)

(58) Field of Classification Search
CPC .... D07B 2201/1004; D07B 2201/2068; D07B 2401/2005; D07B 2501/2061; B63B 21/20; B63B 2021/203
See application file for complete search history.

(56) References Cited

U.S. PATENT DOCUMENTS

| | | | | |
|---|---|---|---|---|
| 9,056,656 | B2 | 6/2015 | Fields | |
| 9,573,661 | B1 * | 2/2017 | Plaia | B63B 21/20 |
| 2013/0145740 | A1 | 6/2013 | Schulz | |
| 2022/0063768 | A1 * | 3/2022 | Fields | D07B 1/00 |

* cited by examiner

SYNTHETIC ROPE FOR SYSTEM LEVEL RECOIL CONTROL

CROSS-REFERENCE TO RELATED APPLICATIONS

This application claims the benefit of U.S. Provisional Patent Application Ser. No. 63/381,814, filed on Nov. 1, 2022, the content of which is incorporated herein by reference in its entirety.

FIELD OF DISCLOSURE

This disclosure is directed to a rope system comprising a synthetic rope, more particularly to a rope system comprising a synthetic rope component having controlled recoil upon rope failure, and method for providing a rope system for system level recoil control.

BACKGROUND

Ropes are used in many high-tension applications, including vessel mooring, marine towing, and ground-based towing and vehicle recovery. As a result of cumulative damage from external forces from environmental exposure, abrasion and ordinary use, these ropes are subject to potential failure which can lead to failure of rope systems and catastrophic results when that failure occurs while the rope is under tension and in use.

To date, reduction of safety risks in these cases has largely focused on control of the released strain energy within the tensioned rope section that fails and the potential recoil hazards attendant upon that release. Methods have been proposed to mitigate the release of the strain energy or to guide the potential paths that a recoiling rope might follow upon failure. The primary assumption of these efforts, though, is that it is the strain energy of the failed or failing rope that must be addressed.

Typically, though, the failed rope in these kinds of high-tension applications is but one component of a larger system, i.e., a rope system. Often, the system will include multiple individual ropes of different types in series, with each rope component selected for a particular desired characteristic for use within the system, along with various forms of hardware, such as shackles, chocks, and cleats. Each of these components has some degree of strain energy stored within it when the overall rope system is tensioned during use. If the system fails at any point, the strain energy of all components is released and can translate to recoil of any or all parts of the system.

Thus, controlling strain energy within just one of the rope components in the system is not sufficient to ensure safety. Further, as many of the ropes within the system are selected for specialty characteristics that derive from specialty constructions and fiber selection, it is also impractical to stipulate that all rope components in the system must be designed to contain their own strain energy when tensioned upon failure of the system. Moreover, some forms of hardware can contain sufficient strain energy that their contribution to system recoil potential must also be addressed to ensure overall safety.

There are some industry standards and guidelines with respect to components in designing and configuring a rope system so that each component does not fail under the design conditions. However, it is still possible for the rope system to fail due to, e.g., sudden impact force, other loads not considered in the design conditions, or wear of the system, and the potential for recoil hazard still exists.

Therefore, there remains a need for a rope system having controlled recoil, preventing or mitigating system level recoil hazards.

SUMMARY

Exemplary embodiments address these deficiencies in current rope systems by providing a rope system with a synthetic rope for use as a component in the rope system that results in system level recoil control upon that rope component's failure and providing methods for designing such a rope system and rope.

Exemplary embodiments provide a rope system with system level recoil control by controlling where failure in the rope system will occur and how much energy absorption will be required considering the operation environments.

In some embodiments, a rope system for system level recoil control includes a first rope component and a second rope component, and the second rope component is connected in series to the first rope component. The first rope component includes a first rope subcomponent and a second rope subcomponent, the first rope subcomponent has predetermined failure strength and is designed and configured to be a controlled failure point for the system, and the second rope subcomponent has a predetermined elongation capability. The rope system contains strain energy when the first and second rope components are in tension, and each rope component contains a fraction of the rope system's strain energy. Upon failure of the first rope subcomponent, the second rope subcomponent is configured to elongate to absorb a predetermined amount of predetermined operational strain energy of the rope system and to stretch over a predetermined distance and/or predetermined period of time before the second rope subcomponent fails.

In some embodiments, a rope system for system level recoil control includes a rope component including a first rope subcomponent and a second rope subcomponent. The first rope subcomponent has predetermined failure strength and is designed and configured to be a controlled failure point for the system. The second rope subcomponent has a predetermined elongation capability. The rope system contains strain energy when the rope component is in tension, and the rope component contains a fraction of the rope system's strain energy. Upon failure of the first rope subcomponent, the second rope subcomponent is configured to elongate to absorb at least 70% of predetermined operational strain energy of the rope system prior to failure of the second rope subcomponent.

In other embodiments, a method for providing a rope system for system level recoil control includes identifying components of a rope system having at least two rope components connected in series, at least one of the rope components having a first rope subcomponent and a second rope subcomponent; determining total maximum strain energy of at least the two rope components when the rope system is subject to a predetermined operational load; determining elongation of the second rope subcomponent to absorb at least 50% of the determined total strain energy upon failure of the first rope subcomponent of the first rope component; and providing the first rope component having the first rope subcomponent with predetermined failure strength and having the second rope subcomponent with elongation greater than or equal to the determined elongation.

Other features and advantages of the present invention will be apparent from the following more detailed description of exemplary embodiments, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION

Figure 1:
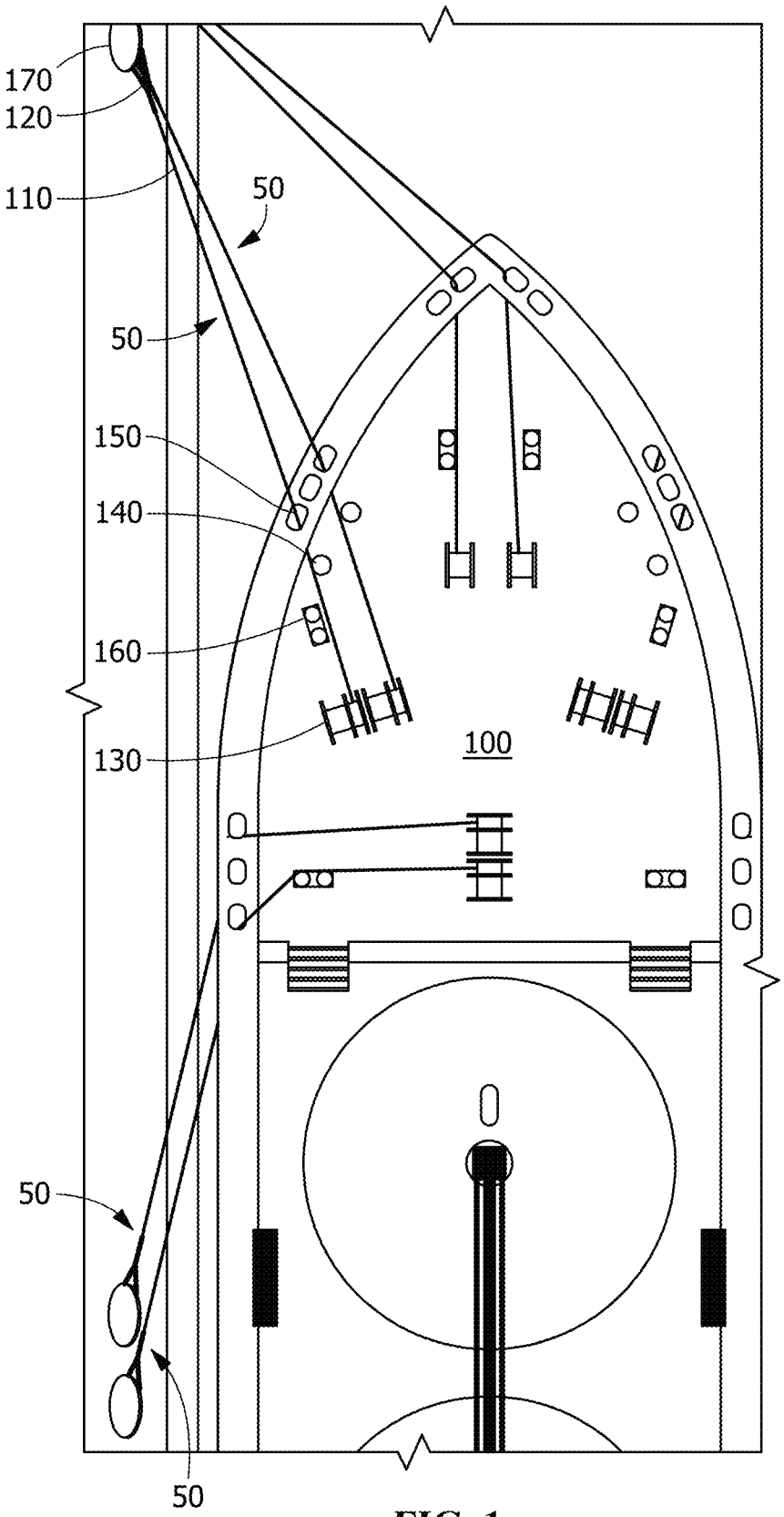
FIG. 1 is a schematic diagram showing a plurality of exemplary rope systems in the context of a moored vessel.

Exemplary embodiments provide for a rope system with a synthetic rope having a strain energy control construction that is purposely designed to control the overall strain energy within the system. While described primarily with respect to vessel mooring for purposes of context, it will be appreciated that this is exemplary only and that the principles of the invention may be applied to any multi-rope system in which it is desired to provide a rope component that accounts for and provides recoil control with respect to a major fraction of the entire rope system's potential stored strain energy at failure.

When a vessel is moored by a rope system, the vessel is exposed to and under various environmental loads, such as, wind and current, and these environmental/operational loads cause the vessel's relative motion. In turn, the vessel's relative motion exerts loads on each component of the rope system. Loads exerted on rope components cause tension in the rope components and are stored therein as strain energy. When they fail, the stored strain energy not only in the rope components but also in the other components of the rope system will be released as a form of recoil and, therefore, pose a potential recoil hazard to surrounding areas.

The rope system according to the disclosure is useful for any mooring system, particularly in the context of marine vessel mooring, whereby an inventive rope component serves as a controlled failure point of the rope system. The inventive rope system provides a rope system for system level recoil control as compared to a single rope component recoil control known in the art. In particular, the rope system provides system level recoil control with a strength rope component as an intended controlled failure point of the system and a high elongation rope component that enables the rope system to provide system level recoil control by providing predetermined elongation upon failure of the system such that such elongation absorbs the strain energy stored in the system and provides predetermined warning time stretch, thus preventing or mitigating the potential recoil hazard upon failure of the rope system.

Depending on various requirements for a rope system, such as the size of vessels, the number of ropes that can be used in the rope system, the required minimum strength of ropes, and the required length of ropes, and environmental conditions, such as wind and current at sites, the degree and extent to which system level recoil control is required may vary. The present invention may provide prevention of the system level recoil or mitigation of the system level recoil depending on specific needs. For example, 50%, 60%, 70%, 80%, 90%, or greater of the total determined rope system strain energy may be dissipated through the elongation of the elongation component.

This includes accounting for multiple, and potentially for each, component of the overall rope system for their respective contribution to system strain energy and constructing the rope to absorb the requisite fraction of the system's strain energy and thereby limit the potential for recoil hazards.

In some embodiments, a mainline may be a strain energy capture component of a rope system. A strain energy capture component of an overall rope system in accordance with exemplary embodiments has two or more subcomponents each with different failure characteristics. At least one subcomponent of the rope component is incorporated for rope strength. A second subcomponent of the rope component is incorporated for high elongation capabilities. Additional subcomponents may be incorporated to enhance the contribution of strength, elongation, or other desired characteristics of the rope. Yet, in other embodiments, a tail may be a strain energy capture component of a rope system.

If the overall rope system fails, the strength subcomponent of a particular rope component in accordance with exemplary embodiments is designed to be the weak point for the entire rope system and serves as a controlled failure point. Because the strength subcomponent is the controlled failure point, the load under which the rope system will fail can be determined in light of the characteristics of the strength subcomponent. It will be appreciated that the load under which the rope system will fail may be expressed in various ways.

After the strength subcomponent fails, a high elongation subcomponent of the rope component is free to elongate in response to the current system tension. This elongation absorbs the strain energy from the system and negates the recoil hazard.

The degree of elongation to absorb sufficient strain energy to reduce recoil hazards depends on a number of factors of a potential rope system, including the component parts to be used and is generally not just empirical due to the large number of possible variations for various rope systems. In some embodiments, mathematical models permit calculation of the strain energy stored within each component of the rope system as well as the energy absorption of the high elongation subcomponent of the strain energy controlling rope. These calculations may then in turn be used to design a rope for use based on a safety factor of the maximum strain that may be anticipated at the time of failure using the identified components across a variety of possible configurations or may be used to inform rope construction of specific configuration identified for a particular set of components.

Turning to FIG. 1, a plurality of rope systems 50 are shown in the context of a moored vessel 100. Rope systems in accordance with exemplary embodiments include at least two rope components. As illustrated in FIG. 1, the rope system includes a mainline 110 as a first rope component and a tail or pendant 120 as the second rope component that is spliced or otherwise connected in series with the mainline 110. The mainline 110 (FIG. 1) is a strain energy capture component of the rope system 50 although the tail 120 may have greater tensile strength, such as about 25% to 30%, than the mainline 110. However, it will be appreciated that the tail 120 may have different ranges of tensile strength relative to the mainline 110. In some applications, a third rope component, such as a backer line (not shown), may be spliced or otherwise connected to the mainline 110 in series at the opposite end of the mainline 110 from that to which the tail 120 is attached. Still more rope components may be employed within the rope system.

Some of the rope systems 50 illustrated in FIG. 1 also include one or more non-rope hardware components such as a winch 130, fairlead 140, chock 150, bitt 160, and/or cleat 170. As illustrated with respect to the moored vessel 100, the hardware components have a fixed position on or with respect to the vessel, although rope systems 50 may also include hardware components that do not have a fixed position. In other embodiments, such as in land-based applications, one or more non-rope hardware components may be, for example, trailer hitches or come-alongs.

It will be appreciated that the system shown in FIG. 1 is exemplary only and that other configurations of rope systems and components used therewith may be employed as known to those of ordinary skill in the art. It will further be appreciated that the systems and components may vary depending on the particular application for which the rope system is employed, such as land and marine towing and land vehicle recovery, for example, in addition to the vessel mooring illustrated in FIG. 1.

Once the components that will be used in a given rope system are known, the components can be individually assessed for the potential amount of strain energy that they might release upon failure of any portion of the rope system under the planned maximum operational load (which may further include an additional safety factor). As a result, a total amount of strain energy to be accounted for can be determined. The determined strain energy includes at least two rope components under tension and may include all rope and/or all rope and non-rope components within the system depending on their expected relative contribution and may further take into account wear within the system (e.g., if a mainline is most likely to fail after its initial strength has decreased to 75% as a result of service, the determined strain energy that component contributes to the system may be adjusted accordingly).

The assessment of individual component contribution may be performed through analysis using known material and mechanical characteristics of the part or device, including material of construction, length, diameter, number of strands, braid structure, etc. of the rope components. Alternatively, or in combination therewith, testing may be conducted on samples of one or more of the system components if the mechanical characteristics are such that an analytical approach to calculate stored strain energy is complex. For rope-based components of the overall rope system, an empirically based analytical approach may be used in which testing of similar ropes under controlled conditions allows the formation of a strain energy model that can be used for strain energy assessment of other diameters and lengths.

Some non-rope components of the rope system, such as chocks and cleats, for example, that contact the rope components over a limited distance may, in some instances, not appreciably contribute to the overall strain experienced by the system in which case they may or may not be taken into account when determining the total strain to be accounted for by the recoil prevention mechanism. Non-rope components are generally well supported by other structures, e.g., girders, frames, beams, or a dock, pier, or quay, and deform to a lesser extent as compared to the rope components, and strain energy stored in the non-rope components is generally minor relative to that in the rope components, i.e., the high modulus mainline and low modulus stretchy tail, and will likely be absorbed by the other structures upon failure of the rope system. As a result, in some systems it may be determined that non-rope components are likely to have minor effects on recoil and thus may not be considered relative to the system's operational strain energy. However, strain energy stored in the non-rope components may be considered in determining the strain energy to be absorbed if the non-rope components are not well supported by other structures.

Figure 2:
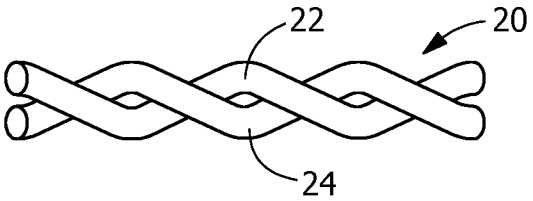
FIG. 2 is a schematic diagram showing rope components of an exemplary rope system.

A rope component 20 of the rope system 50 is illustrated in FIG. 2 and may be the rope component used as the mainline 110 (FIG. 1) and which may be designed as the primary consumable portion of the rope system, providing an anticipated portion of the system in which an eventual failure is expected to occur first. Suppose that the mainline 110 (FIG. 1) is a strain energy capture component of the rope system 50 (FIG. 1), if the load reaches the determined load, the mainline 110 (FIG. 1) will fail and break. The tail 120 (FIG. 1) will elongate until the mainline 110 (FIG. 1) breaks but not break at the determined load because the tail 120 (FIG. 1) has greater strength than the mainline 110 (FIG. 1).

The rope component 20 has first and second rope subcomponents 22 and 24 physically combined such that the rope component 20 does not fail in a single stage when subjected to excess tension loads. Instead, the properties of the first and second rope subcomponents and the manner in which the first and second rope subcomponents 22 and 24 are combined cause the rope component 20 to fail in at least two stages under excess tension loads. The first rope subcomponent 22 of the rope component has predetermined tension failure characteristics designed to meet the maximum tensile load defined by the intended use of the rope component 20. The first rope subcomponent 22 thus may also be referred to as the strength subcomponent. This first rope subcomponent acts as an intentional failure point so that when the tensile strength of the first rope subcomponent 22 is exceeded either because the load is in excess of the defined maximum or because of reduced tensile strength as a result of service induced wear, the first rope subcomponent 22 fails.

A first stage of tension failure begins with a failure of the first rope subcomponent 22. The first rope subcomponent may have low elongation, so that when the tensile strength is exceeded, the first rope subcomponent fails quickly. The first rope subcomponent 22 will break at a certain break strength, and the minimum break strength for the first rope subcomponent 22 of the mainline may be determined by design conditions, such as the dimensions or size of a ship to be moored by the mainline, industry standards or guidelines, or specific needs. The operational load under which the first rope subcomponent 22 will break defines the planned maximum operational load (which may further include an additional safety factor). The strength of the first rope subcomponent 22 may be determined by the total denier of the highest tenacity fiber. The material forming the first rope subcomponent 22 of the rope component 20 is a lower elongating material than the second rope subcomponent 24 and may be any one or more yarns with tenacity greater than, for example, approximately 6 grams per denier (gpd) to serve as the strength component. In some embodiments, a tenacity of the first rope subcomponent 22 may be greater than 18 grams per denier (gpd). The first rope subcomponent 22 may be comprised of ultra-high molecular weight polyethylene (UHMWPE), high molecular polyethylene (HMPE), liquid crystal polymer (LCP), para-aramid fibers, or combinations thereof. It will be appreciated that other materials suitable for the first rope subcomponent 22 may be employed. Surface modifications may be accomplished through the blending of other fiber or fibers with the high tenacity strength component to obtain the desired surface characteristics.

Before or when the first rope subcomponent 22 breaks, the full load is transferred to the second rope subcomponent 24, which elongates until the second rope subcomponent 24 also breaks. Without the second rope subcomponent 24, strain energy stored in the rope system, particularly strain energy stored in the mainline and tail until the mainline breaks, will be released and pose a potential recoil hazard to surrounding areas, such as by causing the failed mainline to travel with the potential to inflict physical harm to the surrounding areas. With the second rope subcomponent 24 in the rope system, however, the second rope subcomponent 24 will absorb the strain energy to be released by the rope system failure, guide the potential paths that the failed mainline may follow, and provide a predetermined warning time stretch, and thus prevent or mitigate the potential recoil hazard.

The strain energy under operation to be absorbed by the elongation component may be determined by the strain energy stored in the first rope subcomponent of the mainline, tail, and other components when the first rope component fails. When a mainline is a strain energy capture component of a rope system, the operational strain energy may be determined as follows: Operational Strain Energy=Strain $\text{Energy}_{First\ Rope\ Subcomponent}$+Strain $\text{Energy}_{Tail}$+Strain $\text{Energy}_{Other\ Components}$. The operational strain energy may be expressed in a general form to include non-mainline/tail configurations as follows: Operational Strain Energy= Strain $\text{Energy}_{First\ Rope\ Subcomponent}$+Strain $\text{Energy}_{Second\ Rope\ Subcomponent}$+ . . . +Strain $\text{Energy}_{Nth\ Rope\ Subcomponent}$+Strain $\text{Energy}_{Other\ Components}$, where a strain energy capture component includes N number of subcomponents. The strain energy stored in other components, e.g., non-rope components, may be included and considered in determining the strain energy if they are not minor relative to that in the first rope subcomponent and tail.

The strain energy stored in the first rope subcomponent may be determined by taking into account the lengths of the first rope subcomponent, the elongation of the first rope subcomponent at which the first rope subcomponent will fail, the determined load under which the first rope subcomponent will fail, and the characteristics of the first rope subcomponent. The strain energy stored in the first rope subcomponent may be a function of the break strength of the first rope subcomponent, the elongation of the first rope subcomponent at break of the first rope subcomponent, and the length of the first rope subcomponent. The strain energy stored in the first rope subcomponent may be expressed in a linear function or nonlinear function. The elongation of the first rope subcomponent at which the first rope subcomponent will fail may be obtained by testing the first rope subcomponent at break strength.

The strain energy stored in the tail may be determined by taking into account the lengths of the tail, the elongation of the tail at which the first rope subcomponent will fail, the determined load under which the first rope subcomponent will fail, and the characteristics of the tail. The elongation of the tail at a given load may be obtained by using the axial stiffness of the tail and given load. The axial stiffness may be expressed in a function of the applied load and can be a nonlinear function. The strain energy stored in the tail may be a function of the break strength of the first rope subcomponent, the elongation of the tail at break of the first rope subcomponent, and the length of the tail. The strain energy stored in the tail may be expressed in a linear function or nonlinear function. The elongation of the tail when the first rope subcomponent fails may differ based on the material of the tail. The tail comprises a polymer having high elongation, such as nylon, polyolefin, or polyester, for example. It will be appreciated that other materials suitable for the tail may be employed.

Once the maximum operational load of the system (i.e., the maximum strain energy under load at which the system is expected to experience without failure) to be absorbed by the elongation component is determined, details of the elongation component may be determined to enable the rope system to provide system level recoil control by providing predetermined elongation upon failure of the system. The predetermined elongation of the elongation component may be such that such elongation absorbs the strain energy stored in the system and provides a predetermined warning time stretch, thus preventing or mitigating the potential recoil hazard upon failure of the rope system. The energy to be absorbed may be determined by taking into account the lengths of the elongation component, the predetermined elongation, the determined load under which the elongation component will elongate, and the characteristics of the elongation component. The elongation component may be comprised of a plurality of strands.

Upon failure of the first rope subcomponent 22, the load is transferred to the second rope subcomponent 24. The second rope subcomponent 24 may or may not be under tension until after the first rope subcomponent 22 fails. The second rope subcomponent 24 has higher elongation than the first rope subcomponent 22, allowing it to stretch over a predetermined distance and/or predetermined period of time before the second rope subcomponent 24 also fails. The elongation at break of each of the first and second rope subcomponents 22, 24 may vary based on a variety of design considerations, although the relative difference in elongation at break between the two rope subcomponents generally ranges between 6% and 19%, e.g., if the elongation at break of the first rope subcomponent 22 is 100, the elongation at break of the second rope subcomponent would be between 106 and 119, and in some embodiments may range between 2% and 200%. In some embodiments, it may be desirable to minimize the differences in elongation at break between the two, while still accomplishing dissipation of system level strain energy. The exact difference in elongation at break between the two rope subcomponents 22, 24 will be used in the analytical design model used to create the construction parameters for the strain energy controlling rope. The material forming the second rope subcomponent 24 of the rope component 20 may be any one or more yarns with tenacity greater than, for example, approximately 0.5 grams per denier (gpd).

In accordance with exemplary embodiments, the elongation of the second rope subcomponent 24 prior to failure is predetermined to occur over a range of time and/or distance corresponding to that which permits the release of cumulative strain energy determined for two or more components of the rope system. As a result, by the time the second rope subcomponent 24 finally fails, 50%, 60%, 70%, 80%, 90%, or greater of the total determined rope system strain energy has been dissipated through the elongation of the second rope subcomponent 24.

Similar to initial determination of the cumulative strain of multiple system components and/or the entire rope system, determination of the construction parameters for the high elongation subcomponent 24 of the rope component 20 involves a similar empirically based analytical approach. Testing is generally performed to provide an empirical basis, as the complex interactions between subcomponents of a rope are difficult to fully address analytically. An analytical model resulting from the testing may be specific to the nature of the high elongation subcomponent of the strain controlling rope component as well as possibly being specific to the rope construction type, e.g., 3 strand, 8 strand, 12 strand, etc. Use of a model allows projection of the construction parameters needed along a range of diameters and the strain energy levels desired to be absorbed.

In some embodiments, because the first rope subcomponent 22 has low elasticity, the second rope subcomponent 24 may be employed in the following manner: inside a strand, beside a strand, loafer strand or multiple ends per carrier, replacing a strand, as a cover on a load bearing core, disposed inside the rope as a separate unit, or as a separate rope. The second rope subcomponent 24 may be determined to maximize the strength and elongation of the mainline at break and set to offset total system energy.

Figure 4:
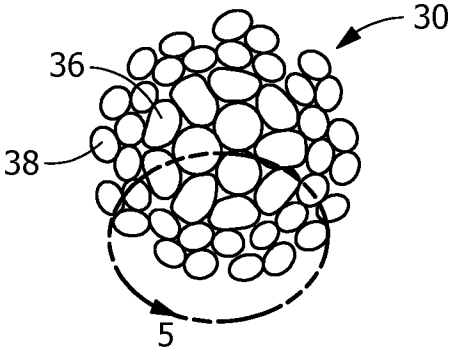
FIG. 4 is a cross-section view of the rope system shown in FIG. 3.
Figure 5:
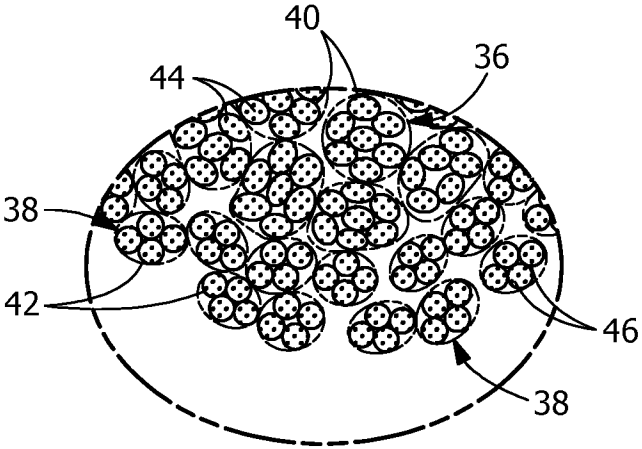
FIG. 5 is a close-up view of a portion of FIG. 4.
Figure 3:
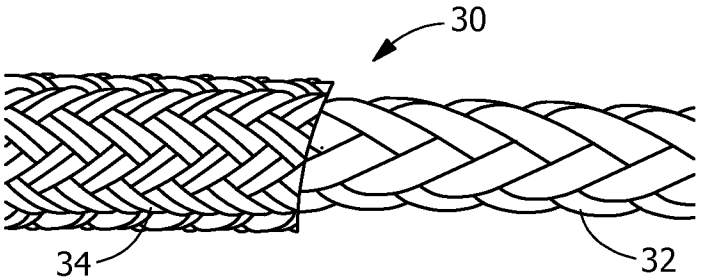
FIG. 3 is a schematic diagram showing an exemplary rope system.

Referring to FIGS. 3, 4 and 5, the rope component may be constructed as a core 32 and jacket 34 configuration forming a core/jacket rope component 30 in which the first rope subcomponent 22 is provided either as the core or the jacket and the second rope subcomponent 24 is provided as the other. FIG. 4 also shows that the core 32 and jacket 34 can themselves comprise a plurality of strands 36 and 38, respectively. FIG. 5 shows that the strands 36 and 38 comprise a plurality of yarns 40 and 42 and that the yarns 40 and 42 in turn each comprise a plurality of fibers 44 and 46, respectively. It will thus be appreciated that in some embodiments, the yarns of a first strand comprise the first rope subcomponent 22, while the yarns of a second strand may comprise the second rope subcomponent 24.

The fibers 44 and 46 are the elemental components of the rope component. The example yarns 40 and 42 are formed of fibers 44 and 46 made of synthetic materials. The fibers 44 and 46 are combined to form the yarns 40 and 42 using any one or more of a number of techniques. The strands 36 and 38 are formed by combining the yarns 40 and 42, also by using any one or more of a number of techniques. The techniques for combining fibers to form yarns and combining yarns to form strands are or may be conventional and will not be described herein in detail.

Regardless of whether a core/jacket configuration is used, the rope component is typically constructed via a braiding or twisting process. The rope component may be 3 strand, 8 strand, 12 strand, or any other configuration such as may be known in the art. Other rope constructions in which the first and second rope subcomponents may be used in constructing the rope are also contemplated, including, for example, those set forth in U.S. Pat. No. 7,127,878 which is hereby incorporated by reference in its entirety.

In some embodiments, a method for providing a synthetic rope for system level recoil control includes identifying components of a rope system having at least two rope components connected in series, at least one of the rope sections having a first rope subcomponent and a second rope subcomponent; determining total maximum strain energy of at least the two rope components when the rope system is subject to a predetermined operational load; determining elongation of the second rope subcomponent of the first rope component to absorb at least 50% of the determined total maximum strain energy upon failure of the first rope subcomponent of the first rope component; and providing the first rope component having the first rope subcomponent with predetermined failure tensile strength and having the second rope subcomponent with elongation greater than or equal to the determined elongation.

In some embodiments, determining the total maximum strain energy includes accounting for operational wear of the rope system.

In other embodiments, the method further includes using a mathematical model in determining the total maximum strain energy of at least the two rope components when the rope system is subject to a predetermined operational load.

Yet, in other embodiments, the method further includes determining the relative difference in elongation at break between the first and second rope subcomponents ranging between 2% and 200%. It will be appreciated that different ranges may be employed.

While the invention has been described with reference to one or more exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention but that the invention will include all embodiments falling within the scope of the appended claims. In addition, all numerical values identified in the detailed description shall be interpreted as though the precise and approximate values are both expressly identified.

What is claimed is:

1. A rope system for system level recoil control comprising:

a first rope component comprising:

a first rope subcomponent, the first rope subcomponent having predetermined failure strength, the first rope subcomponent designed and configured to be a controlled failure point for the system; and a second rope subcomponent, the second rope subcomponent having a predetermined elongation capability; and a second rope component connected in series to the first rope component;

wherein the rope system contains strain energy when the first and second rope components are in tension, and each rope component contains a fraction of the rope system's strain energy;

wherein, upon failure of the first rope subcomponent, the second rope subcomponent is configured to elongate to absorb a predetermined amount of predetermined operational strain energy of the rope system and to stretch over a predetermined distance and/or predetermined period of time before the second rope subcomponent fails; and wherein the predetermined elongation capability of the second rope subcomponent corresponds to at least 50% of the predetermined operational strain energy of the rope system, and the at least 50% of the predetermined operational strain energy of the rope system is dissipated through the elongation of the second rope subcomponent prior to failure of the second rope subcomponent.

2. The rope system of claim 1, wherein the first rope subcomponent further comprises a surface modification.

3. The rope system of claim 1, wherein the first rope component comprises three, eight, or twelve strands.

4. The rope system of claim 1, wherein the first rope component comprises a core and jacket, wherein the first rope subcomponent forms the core, and the second rope subcomponent forms the jacket.

5. The rope system of claim 1, wherein the first rope component further comprises a core and jacket, wherein the first rope subcomponent forms the jacket, and the second rope subcomponent forms the core.

6. The rope system of claim 1, wherein a tenacity of the first rope subcomponent is greater than approximately six grams per denier.

7. The rope system of claim 1, wherein a tenacity of the second rope subcomponent is greater than approximately 0.5 grams per denier.

8. The rope system of claim 1, wherein the first rope component is a braided or twisted rope.

9. The rope system of claim 1, wherein the first rope component is a mainline, and the second rope component is a tail.

10. The rope system of claim 1, further comprising at least one non-rope hardware component contributing to the rope system's strain energy.

11. The rope system of claim 10, wherein the at least one non-rope hardware component comprises a winch, fairlead, chock, bitt, cleat, or combinations thereof.

12. The rope system of claim 1, wherein the second rope component comprises a first rope subcomponent and second rope subcomponent.

13. The rope system of claim 1, wherein the relative difference in elongation at break between the first and second rope subcomponents ranges between 2% and 200%.

14. The rope system of claim 1, wherein the relative difference in elongation at break between the first and second rope subcomponents ranges between 6% and 19%.

15. A rope system for system level recoil control comprising:

a rope component comprising:

a first rope subcomponent, the first rope subcomponent having predetermined failure strength, the first rope subcomponent designed and configured to be a controlled failure point for the system; and a second rope subcomponent, the second rope subcomponent having a predetermined elongation capability;

wherein the rope system contains strain energy when the rope component is in tension, and the rope component contains a fraction of the rope system's strain energy; and wherein, upon failure of the first rope subcomponent, the second rope subcomponent is configured to elongate to absorb at least 70% of predetermined operational strain energy of the rope system prior to failure of the second rope subcomponent.

16. A method for providing a rope system for system level recoil control comprising:

identifying components of a rope system having at least two rope components connected in series, at least one of the rope components having a first rope subcomponent and a second rope subcomponent;

determining total maximum strain energy of at least the two rope components when the rope system is subject to a predetermined operational load;

determining elongation of the second rope subcomponent to absorb at least 50% of the determined total maximum strain energy upon failure of the first rope subcomponent of the first rope component; and providing the first rope component having the first rope subcomponent with predetermined failure strength and having the second rope subcomponent with elongation greater than or equal to the determined elongation.

17. The method of claim 16, wherein determining the total maximum strain energy includes accounting for operational wear of the rope system.

18. The method of claim 16, further comprising using a mathematical model in determining the total maximum strain energy of at least the two rope components when the rope system is subject to a predetermined operational load.

19. The method of claim 16, further comprising determining the relative difference in elongation at break between the first and second rope subcomponents ranging between 2% and 200%.

20. A rope system for system level recoil control comprising:

a first rope component comprising:

a first rope subcomponent, the first rope subcomponent having predetermined failure strength, the first rope subcomponent designed and configured to be a controlled failure point for the system; and a second rope subcomponent, the second rope subcomponent having a predetermined elongation capability; and a second rope component connected in series to the first rope component;

wherein the rope system contains strain energy when the first and second rope components are in tension, and each rope component contains a fraction of the rope system's strain energy;

wherein, upon failure of the first rope subcomponent, the second rope subcomponent is configured to elongate to absorb a predetermined amount of predetermined operational strain energy of the rope system and to stretch over a predetermined distance and/or predetermined period of time before the second rope subcomponent fails; and wherein the relative difference in elongation at break between the first and second rope subcomponents ranges between 6% and 19%.

21. A rope system for system level recoil control comprising:

a first rope component comprising:

a first rope subcomponent, the first rope subcomponent having predetermined failure strength, the first rope subcomponent designed and configured to be a controlled failure point for the system; and a second rope subcomponent, the second rope subcomponent having a predetermined elongation capability; and a second rope component connected in series to the first rope component;

wherein the rope system contains strain energy when the first and second rope components are in tension, and each rope component contains a fraction of the rope system's strain energy;

wherein, upon failure of the first rope subcomponent, the second rope subcomponent is configured to elongate to absorb a predetermined amount of predetermined operational strain energy of the rope system and to stretch over a predetermined distance and/or predetermined period of time before the second rope subcomponent fails; and wherein a tenacity of the first rope subcomponent is greater than approximately six grams per denier or a tenacity of the second rope subcomponent is greater than approximately 0.5 grams per denier.

* * * * *